United States Patent [19]

Credle, Jr.

[11] Patent Number: 5,071,038

[45] Date of Patent: Dec. 10, 1991

[54] BEVERAGE DISPENSER SYSTEM USING VOLUMETRIC RATIO CONTROL DEVICE

[75] Inventor: William S. Credle, Jr., Stone Mountain, Ga.

[73] Assignee: The Coca-Cola Company, Atlanta, Ga.

[21] Appl. No.: 528,630

[22] Filed: May 24, 1990

Related U.S. Application Data

[62] Division of Ser. No. 265,203, Oct. 31, 1988, Pat. No. 4,953,754, which is a division of Ser. No. 888,546, Jul. 18, 1986, abandoned.

[51] Int. Cl.[5] ..... B67D 5/56

[52] U.S. Cl. ..... 222/129.2; 222/136; 222/137; 222/249

[58] Field of Search ..... 222/129.1, 129.2, 129.3, 222/129.4, 135–137, 145, 249, 250, 275, 276, 334; 137/99, 98

[56] References Cited

U.S. PATENT DOCUMENTS

| | | | |
|---|---|---|---|
| 2,736,466 | 2/1956 | Rodth | 222/136 |
| 3,591,051 | 7/1971 | Mitchell et al. | 222/249 X |
| 3,640,433 | 2/1972 | Rodth | 222/129.2 |
| 4,684,332 | 8/1987 | Hartley et al. . | |
| 4,741,355 | 5/1988 | Credle, Jr. et al. | 222/129.1 |

*Primary Examiner*—Kevin P. Shaver
*Attorney, Agent, or Firm*—Thomas R. Boston; W. Dexter Brooks

[57] ABSTRACT

A postmix valve for a beverage dispenser, including a volumetric ratio control device incorporated therein to provide positive ratio control. The device includes a double acting piston including a syrup piston and a soda piston linked together, syrup and soda chambers, and valve device for controlling the flow to and from the chambers. The soda pressure drives the pistons. The valve device includes paddle valves. This valve can be used with any of a figal, a bag-in-box, a gravity tank, or a non-returnable container under no pressure or under a low pressure of 5 to 10 psig.

4 Claims, 8 Drawing Sheets

BEVERAGE DISPENSER SYSTEM USING VOLUMETRIC RATIO CONTROL DEVICE

This is a divisional of co-pending application Ser. No. 07/265,203 filed on Oct. 31, 1988, now U.S. Pat. No. 4,953,751 which is a division of application Ser. No. 06/888,546 filed July 18, 1986, now abandoned.

BACKGROUND OF THE INVENTION

1. Field of the Invention

This invention relates to post-mix beverage dispensers and to dispensing valves for mixing together and dispensing a controlled ratio of syrup and carbonated water; more particularly, this invention concerns a volumetric ratio control device in the dispensing valve.

2. Description of the Prior Art

Known post-mix dispensing valves control soda (carbonated water) flow with two mechanical flow controls that are adjusted independently of each other to achieve proper mixture ratio. If either flow control malfunctions or changes, the ratio will change because one flow control cannot compensate for the variations of the other. The mechanical flow controls, which require high flowing pressures (about 50 psig) to function properly, do not compensate for viscosity changes caused by temperature fluctuations. New electrical flow control valves including sensors and microprocessors are being developed to overcome these problems, however, they are relatively complicated and expensive.

SUMMARY OF THE INVENTION

This invention provides a relatively simple, inexpensive, post-mix valve that provides positive ratio control. This valve volumetrically controls the amount of syrup and soda that are mixed together. The volumetric ratio control device (VRCD) includes syrup and soda pistons connected together, associated syrup and soda chambers, and valves for controlling the flow to and from the chambers. The VRCD of this invention provides an improvement over known dispensing valves because it does not require high flowing pressures and because the pistons allow one liquid flow to compensate for fluctuations in the other liquid flow. The VRCD of this invention is simpler and less expensive than the new electrical ratio control valves because it is not concerned with (and does not measure) temperatures, viscosities, syrup characteristics or Reynolds numbers, for example. The VRCD is only concerned with repeatedly filling volumetric measuring chambers and then emptying the chambers into a mixing nozzle.

Another advantage of this VRCD is that it can work with a variety of different post-mix syrup packages. Present pressurized post-mix dispensers require a source of pressurized syrup to operate correctly. This syrup can come from a pressurized figal or from a syrup pump that is connected to a bag-in-box package. However, it is difficult with the present equipment to readily convert from one type of package to another. The VRCD of this invention overcomes this shortcoming because it can work as a pressurized valve or as a valve/pump combination. When operated as a pressure valve, it can function properly with high pressure syrup or with low pressure syrup. Then operated as a valve/pump combination, it can empty the contents of a bag-in-box package, a vented package, or a very low pressure syrup package, without the use of a syrup pump. The VRCD also words with a gravity dispenser and will provide better ratio control than the gravity dispenser valves presently being used. To summarize, the VRCD will work with either a gravity dispenser or a pressurized dispenser. It will work with pressurized containers (figals) or non-pressurized containers (bag-in-box, syrup containers, etc.). Because the VRCD in this invention works with syrups at no pressure and at low pressures, the present invention also includes inexpensive, non-returnable, syrup containers including one that can operate at no pressure and ones that can be pressurized up to about 5 to 10 psig. Such low pressure containers could not previously have been used because of the high pressures required to make the known pressurized dispensing valves operate properly. It is also important to note that the VRCD of this invention can work with all of these different types of dispensers and syrup packages, and it can do so without making any adjustments to the dispensing valve, and without adding any auxiliary equipment (such as a syrup pump) to the valve or dispenser.

It is an object of the present invention to provide a simple, inexpensive, post-mix dispensing valve that can provide positive ratio control.

It is another object of the present invention to provide a beverage dispenser and a beverage dispenser valve that work with a variety of different post-mix syrup packages and that do so without making any adjustments to the valve or adding any auxiliary equipment to the valve or to the dispenser.

It is another object of the present invention to provide a beverage dispenser and a beverage dispenser valve that can readily convert from one type of syrup package to another.

It is another object of the present invention to provide a dispensing valve for a beverage dispenser that can operate as a valve/pump combination that can empty the contents of a bag-in-box package or a non-returnable, low pressure or no pressure syrup package, without the use of a syrup pump.

It is another object of the present invention to provide a beverage dispensing method using a dispensing valve incorporating a volumetric ratio control device for dispensing from a non-pressurizable, collapsible concentrate container without the use of a syrup pump.

It is another object of the present invention to provide a dispensing valve for a beverage dispenser incorporating therein a volumetric ratio control device.

It is a further object of the present invention to provide a beverage dispensing system including a beverage dispenser, a dispensing valve, and a non-returnable, rigid, pressurizable syrup container pressurized to about 5–10 psig.

It is another object of the present invention to provide a non-returnable, pressurizable syrup container for use with beverage dispensers and having sufficient strength to safely hold syrup under pressure no greater than about 5–10 psig.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENTS

Figure 14:
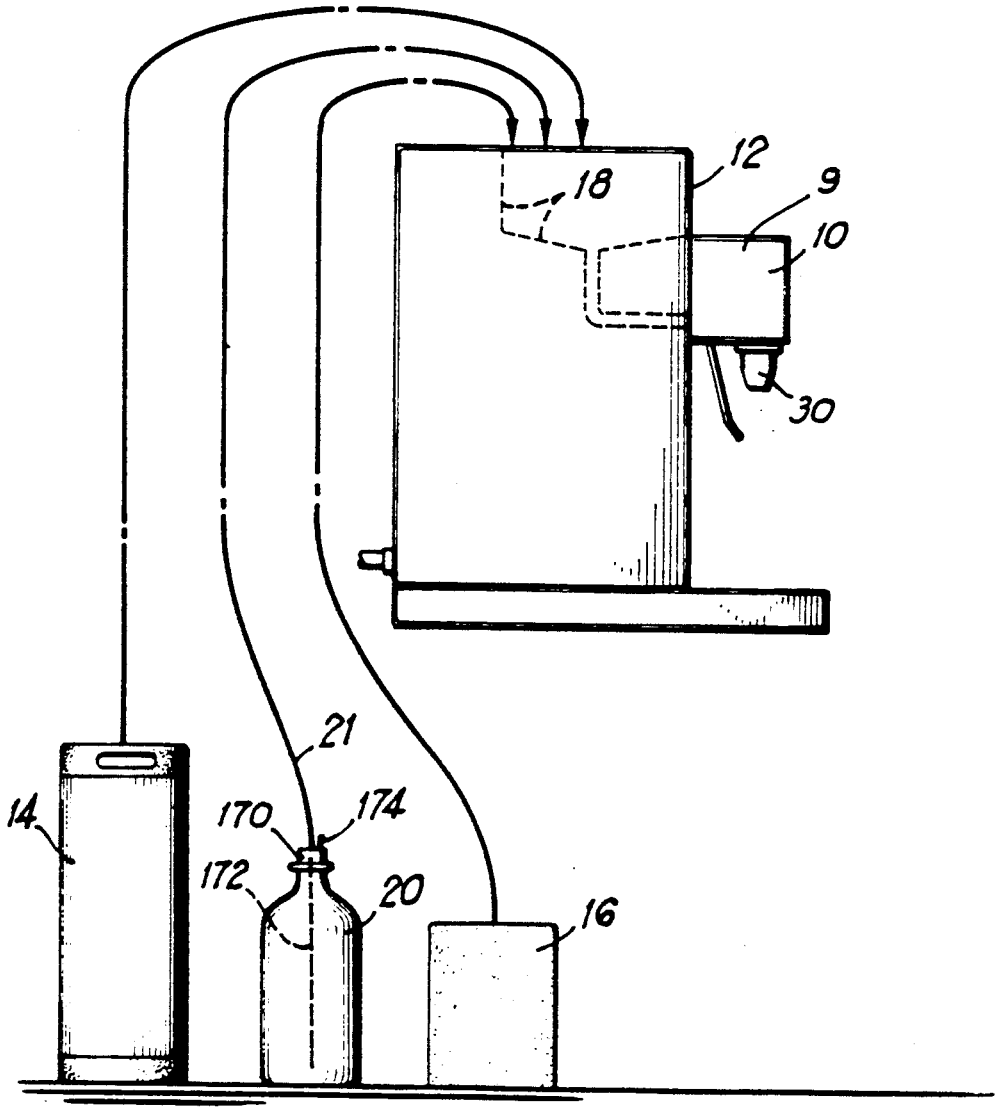
FIG. 14 is a diagrammatic view of a beverage dispenser including a dispensing valve according to the present invention, and showing the four different types of syrup containers useful therewith.

With reference now to the drawings, FIGS. 1-5 show a dispensing valve 10 according to a preferred embodiment of the present invention. The dispensing valve 10 can be mounted on a beverage dispenser 12 as shown in FIG. 14. Any one of a number of the dispensing valves 10 such as four, five or six, for example, can be mounted on the beverage dispenser 12. The syrup source can be a figal 14, a bag-in-box 16, a gravity tank 18 built directly into the beverage dispenser 12, or a non-returnable container 20 according to the present invention and described in more detail hereinafter.

Returning now to the dispensing valve 10 of FIGS. 1-5, the valve includes a body 22 including separate soda and syrup passageways 24 and 26, respectively, therethrough, valve means 28 for controlling the flow through the passageways 24 and 26, a nozzle 30 for mixing together the soda and syrup and for dispensing the mixture therefrom, and e volumetric ratio control device (VRCD) 32 in said body for controlling the ratio of soda to syrup in the beverage dispensed from the valve 10. The valve 10 can include a cover 91 (see FIG. 14), if desired.

The VRCD 32 includes a syrup piston 40, a soda piston 42 connected to the syrup piston 40, a pair of syrup chambers 44 and 46, a pair of soda chambers 48 and 50, two four-way valves 52 and 54, and two solenoids 56 and 58. The soda passageway 24 includes a passageway to each of the soda chambers 48 and 50, and the syrup passageway 26 includes a syrup passageway to each of the syrup chambers 44 and 46.

Figure 1:
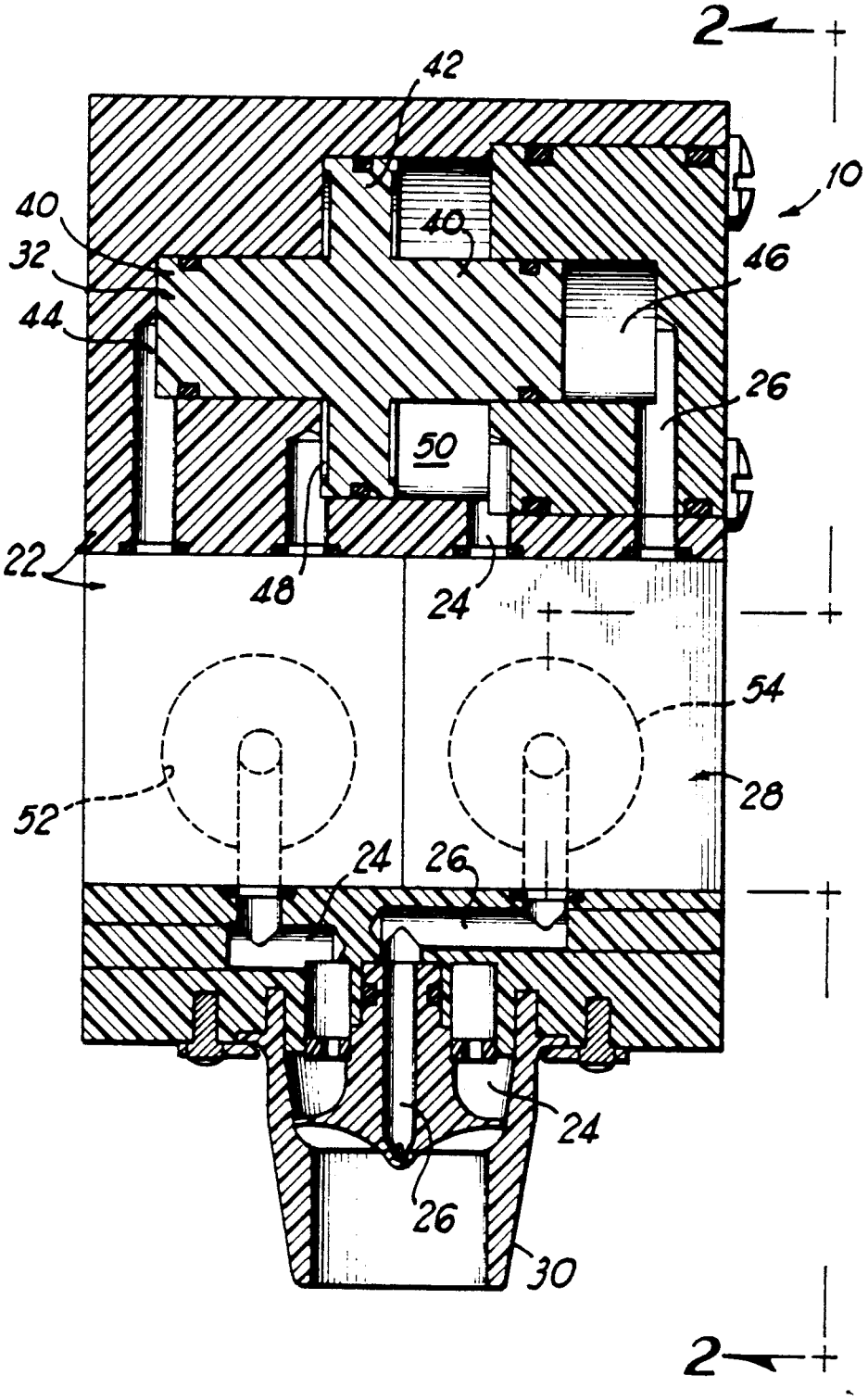
FIG. 1 is a partly cross-sectional end view through a dispensing valve according to one embodiment of the present invention.
Figure 2:
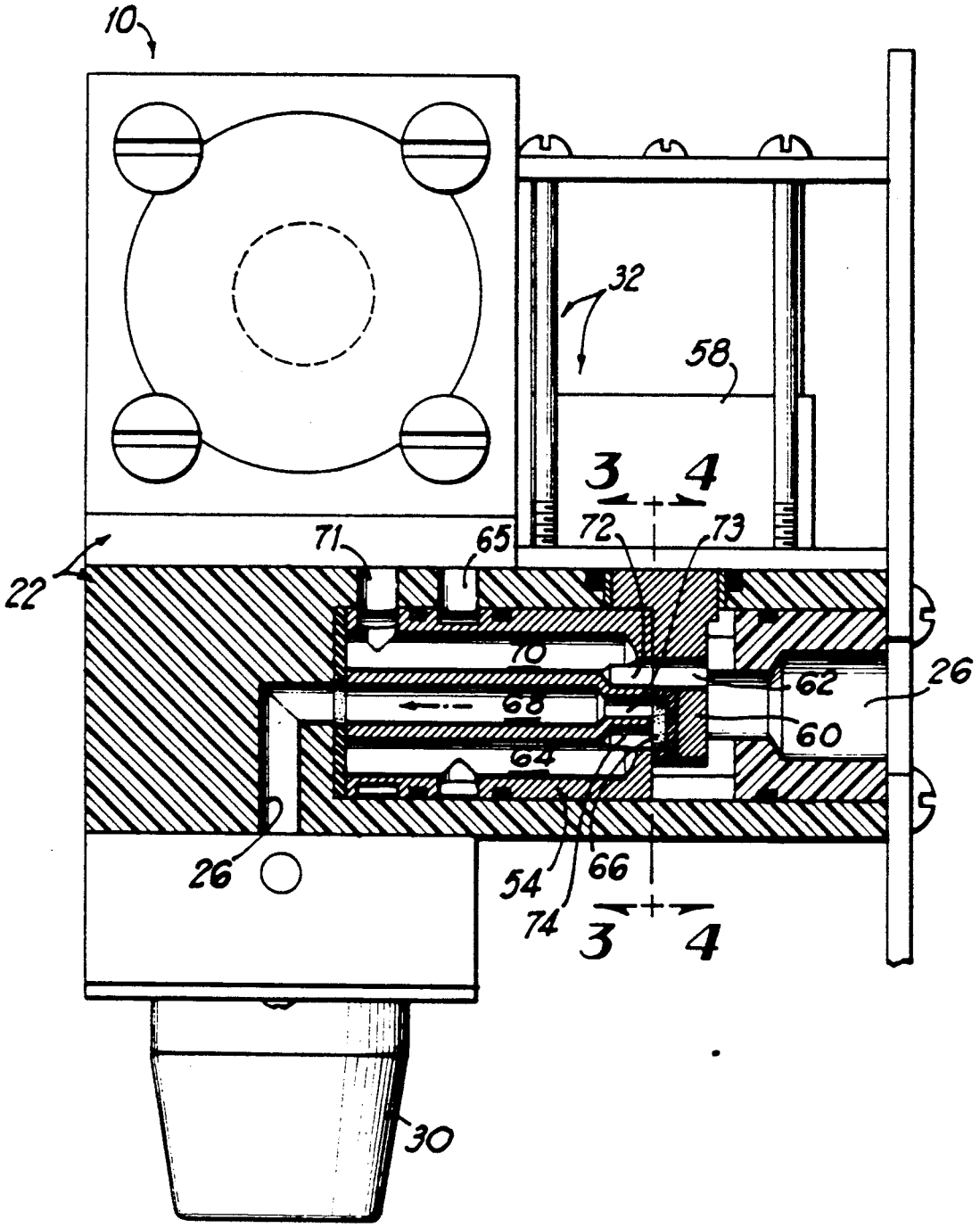
FIG. 2 is a partly cross-sectional side view through the valve of FIG. 1 taken along line 2—2 thereof.

The valve means for controlling the flow through the passageways includes the solenoid 56 and 58, one of which (5B) is shown in FIG. 2 controlling an armature 60 in the syrup passageway 26. When the armature is in the position shown in FIG. 2 (for example, with the solenoid 58 not energized), the syrup can flow through syrup inlet passageway 26, through a port 62 in the armature 60, through passageways 70 and 71, one of the syrup chambers 44 or 46, while at the same time syrup is flowing from the other of the chambers 44 or 46 through the passageway 64, then through the groove 66, end then into passageway 68 where it flows down into the nozzle 30 as shown in FIG. 2. When the syrup piston 40 reaches the end of its stroke, the solenoid 58 is energized to retract the armature 60 to provide communication between the inlet passageway 26 and the other syrup chamber through the passageways 64 and 65, while syrup is forced out of the other syrup chamber into the nozzle through passageway 71, then passageway 70, through groove 66 and then through passageway 68 to the nozzle 30. The same operation occurs on the other side of the dispensing valve with respect to the soda (or carbonated water).

Figure 3:
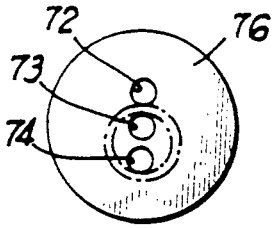
FIG. 3 is an elevational view taken along line 3—3 of FIG. 2.
Figure 4:
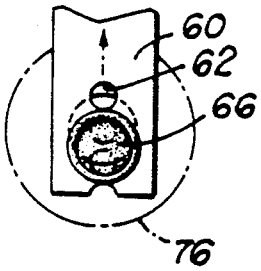
FIG. 4 is an elevational view taken along line 4—4 of FIG. 2.

FIG. 3 shows the three ports 72, 73 and 74 providing communication with the passageways 70, 68 and 64, respectively, in a central member 76. FIG. 4 shows the port 62 and the groove 68 in the armature 60 of the solenoid 58.

Figure 5:
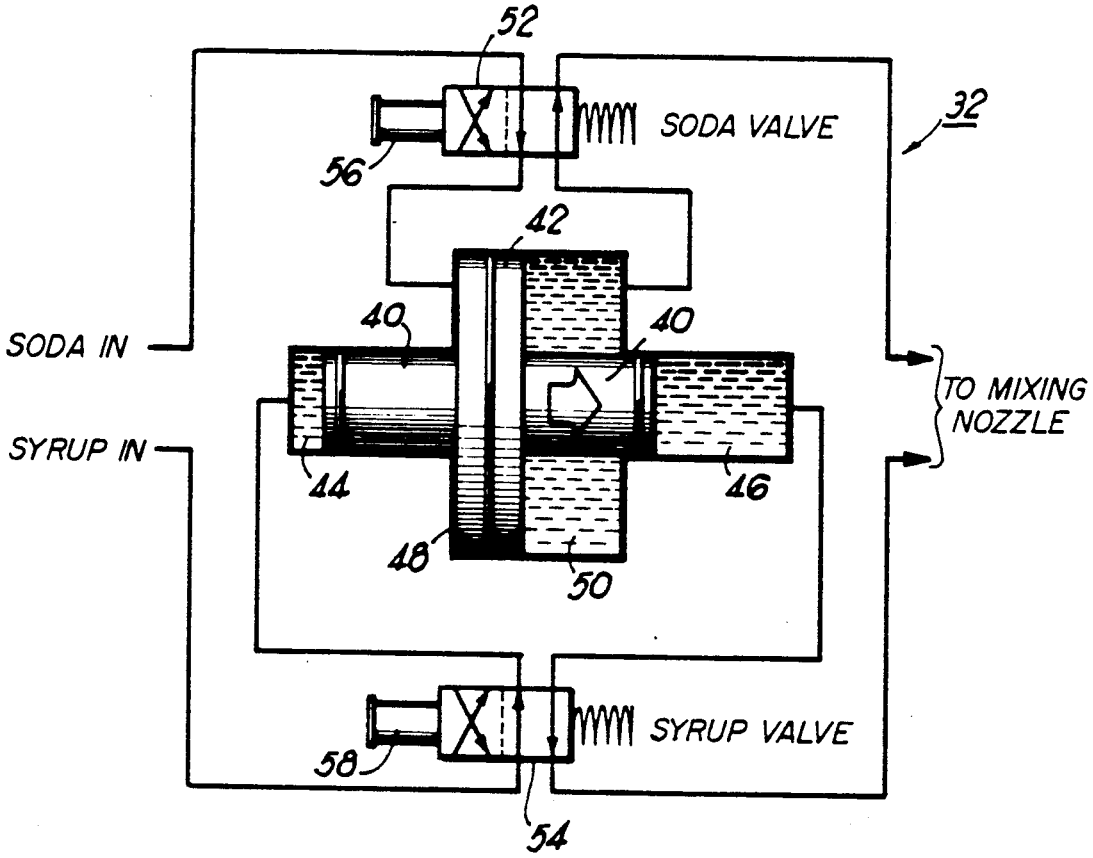
FIG. 5 is a schematic view of the embodiment shown in FIGS. 1 to 4.

The solenoids 56 and 58 and the valves 52 and 54 direct syrup and soda to the left side of the pistons as shown in FIG. 5, while the pistons move from left to right causing the liquids on the right side of the pistons to be expelled into the mixing nozzle. When the piston reach the right-hand end of their travel, the solenoids are energized to activate the valves and thus reverse the flow and cause the liquids on the left side of the pistons to be directed to the mixing nozzle. In a properly sized valve, the pistons will preferably change directions several times each second. In order to change ratio in this type of valve, the pistons/chamber assembly must be replaced with a different sized assembly.

An advantage of placing the VRCD directly in the dispensing valve is to reduce the number of water lines that would be required if the VRCD were placed, for example, upstream of the refrigeration system and the soda and syrup lines were kept separate up to the valve.

Figure 6:
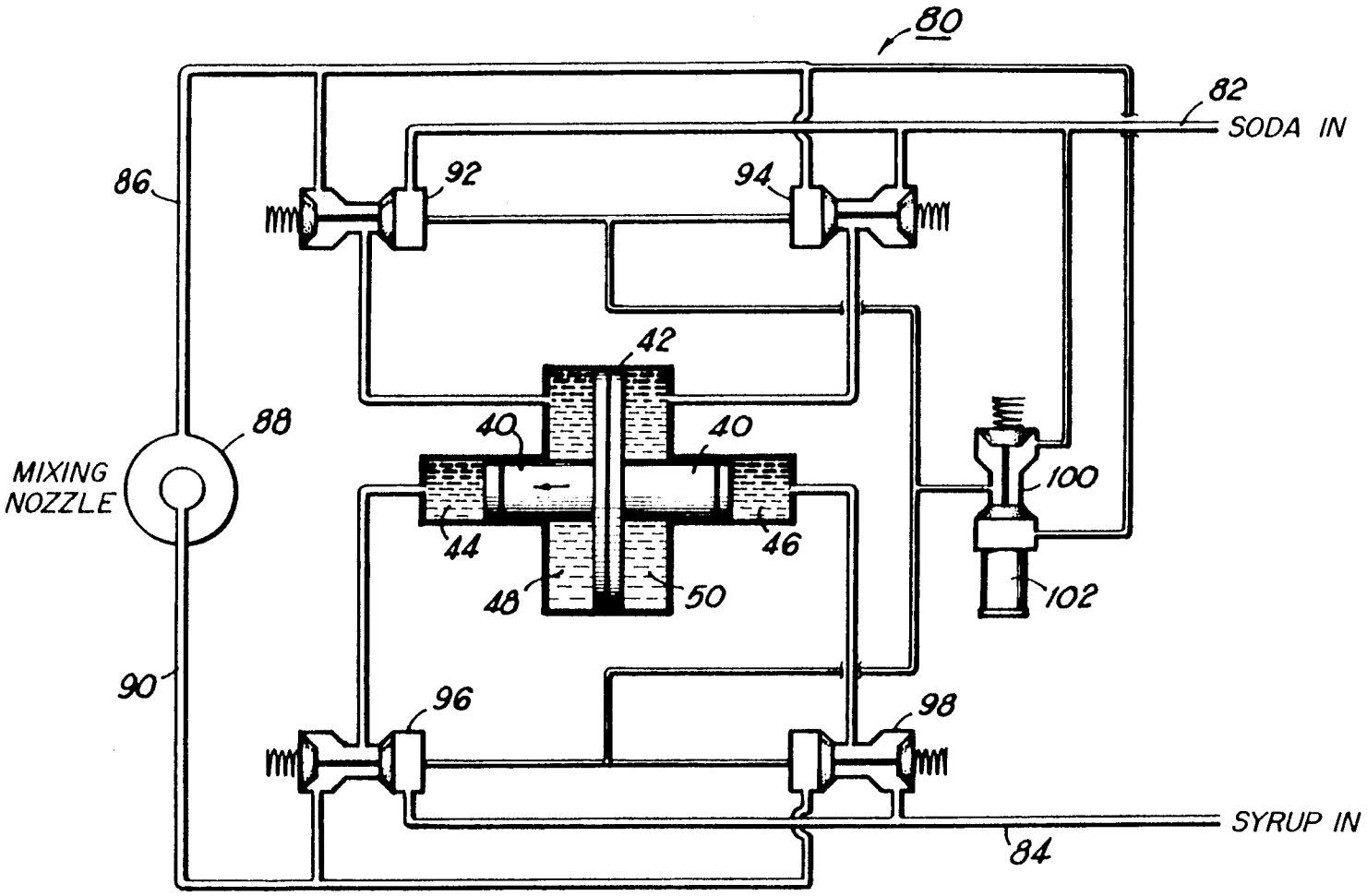
FIG. 6 is a diagrammatic view of another embodiment of the present invention.
Figure 7:
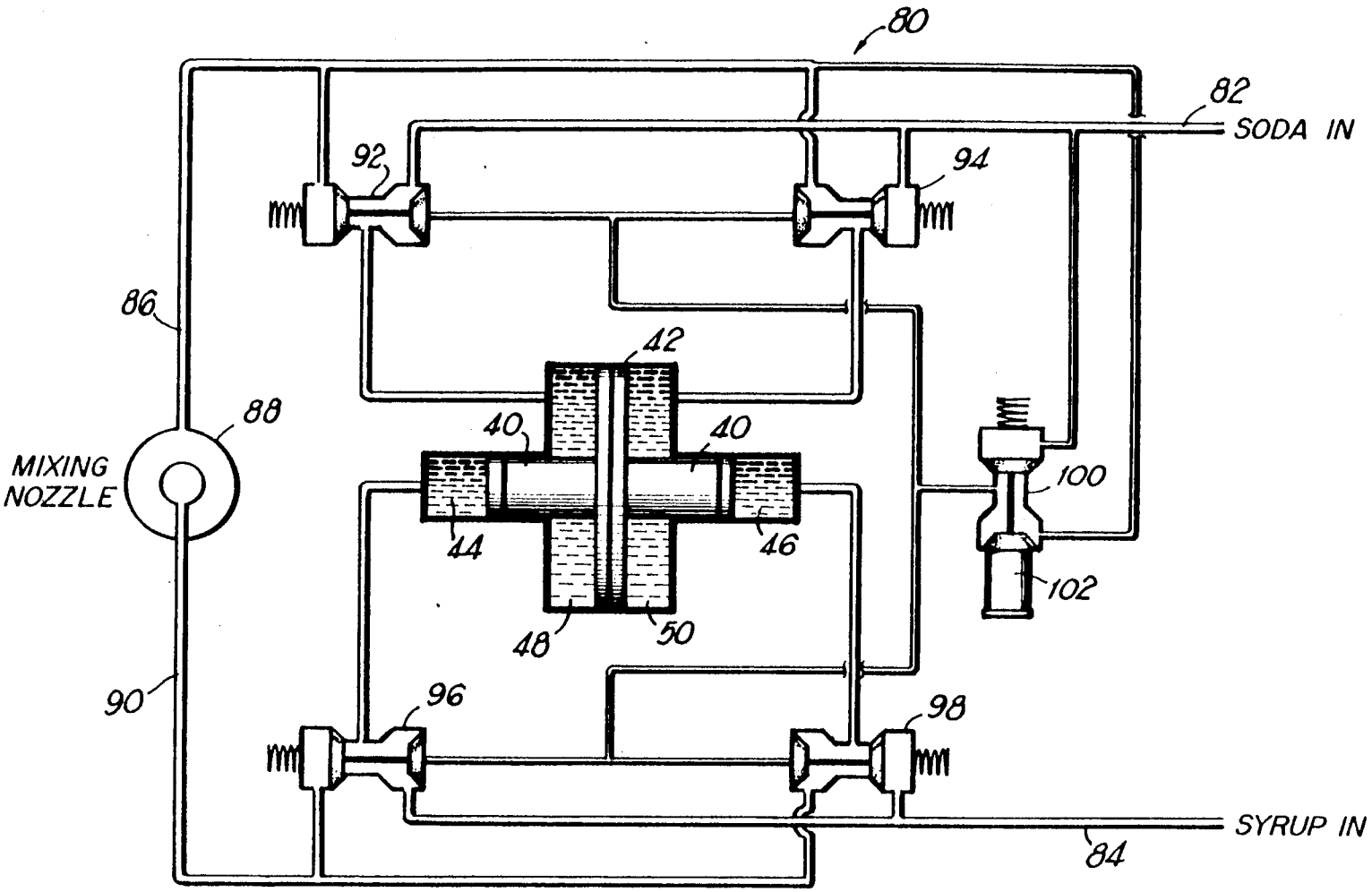
FIG. 7 is a diagrammatic view similar to FIG. 6 but showing the valves in the opposite position to that shown in FIG. 6.

Reference will now be made to FIGS. 6 and 7 which show another embodiment of the VRCD of the present invention, and in particular one using four three-way valves rather than the two four-way valves used in the embodiments of FIGS. 1-5.

FIGS. 6 and 7 show a volumetric ratio control device 80 that can be used in a dispensing valve such as the valve 10 of FIGS. 1-5. FIGS. 6 and 7 diagrammatically show the syrup piston 40, the soda piston 42, syrup chambers 44 and 46, and the soda chambers 48 and 50. The volumetric ratio control device 80 includes a soda-in conduit 82, a syrup-in conduit 84, a soda-out conduit 86 to a mixing nozzle 88, and a syrup-out conduit 90 to the mixing nozzle 88. The volumetric ratio control device 80 includes valve means for controlling the flow in the soda and syrup passageways including four three-way pilot-actuated poppet valves 92, 94, 96 and 98 controlled by a single solenoid-actuated pilot valve 100. The valve 100 is actuated by a solenoid 102. The solenoid-actuated pilot valve 100 uses pressurized soda as the pilot fluid.

FIG. 6 shows the solenoid 102 in its energized condition such that the valve 100 is open to provide pressurized soda communication to the four three-way poppet valves 92, 94, 96 and 98 to position these valves in their orientation shown in FIG. 6 with the pistons 40 and 42 moving to the left as shown in FIG. 6. At the end of the stroke of the piston to the left as shown in FIG. 6, the solenoid 102 is de-energized allowing a spring to move the pilot valve to its position shown in FIG. 7. At this time the soda line to the four three-way poppet valves is vented by the pilot valve 100 which causes the four three-way valves 92, 94, 96 and 98 to move to their position shown in FIG. 7 for use when the pistons 40 and 42 are moving to the right (as shown in FIG. 7), at which time the syrup and soda flow into the leftmost chambers and are forced by the pistons out of the rightmost chambers to the mixing nozzle. This embodiment with the four three-way poppet valves is presently the preferred embodiment.

Figure 8:
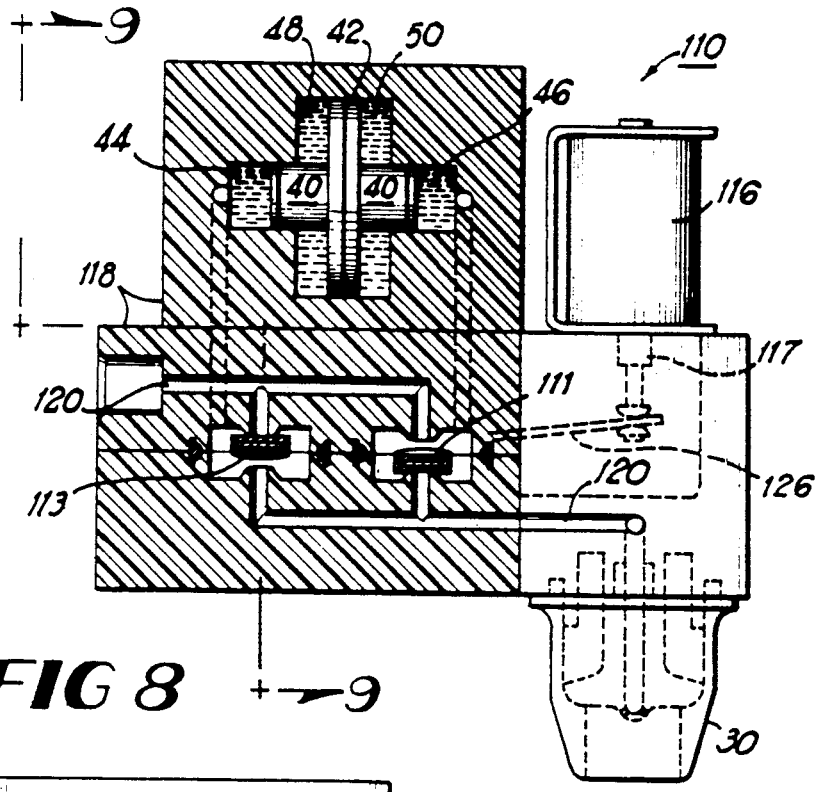
FIG. 8 is a partly cross-sectional side view of a dispensing valve according to another embodiment of the present invention.
Figure 9:
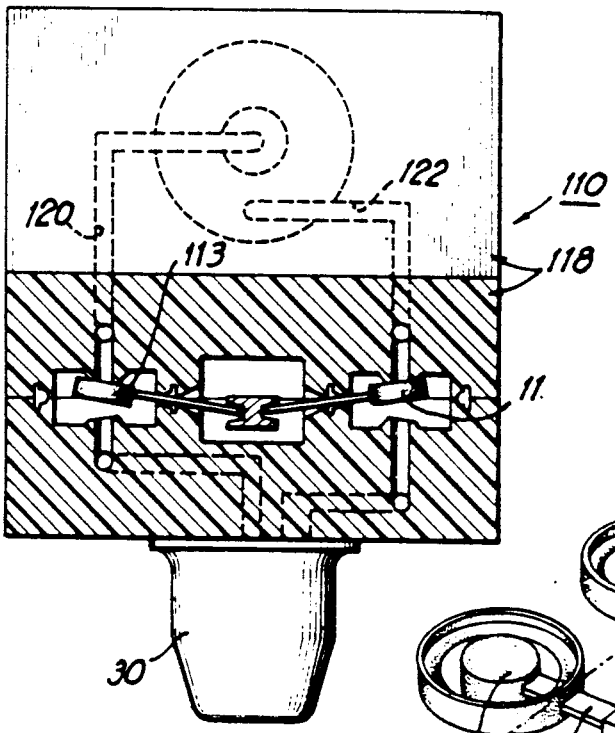
FIG. 9 is a partly cross-sectional end view of the valve of FIG. 8 taken along line 9—9 of FIG. 8.
Figure 10:
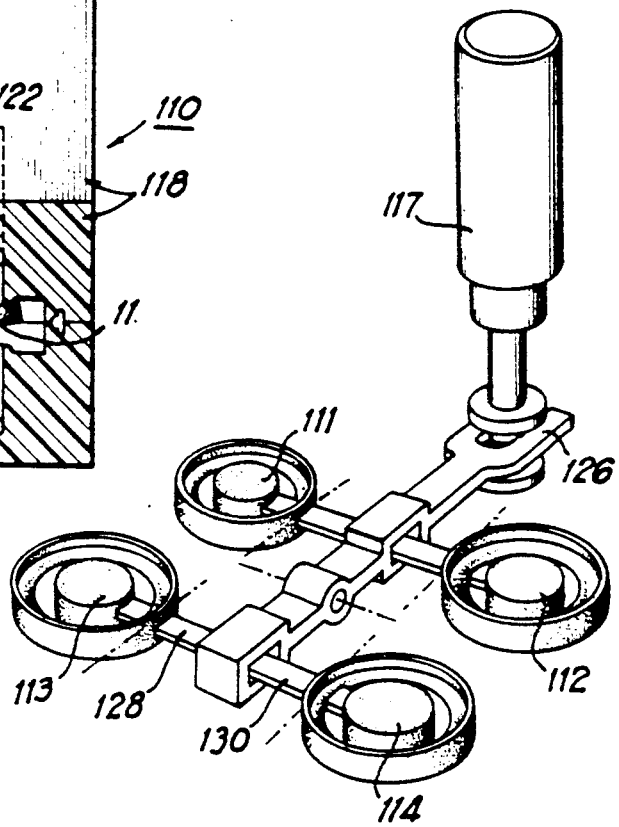
FIG. 10 is a perspective view of the paddle valves used in the embodiment shown in FIGS. 8 and 9.

FIGS. 8 to 10 show a dispensing valve 110 according to another embodiment of the present invention which uses four three-way paddle valves 111, 112, 113 and 114 which are mechanically actuated by a single solenoid 116 having an armature 117. The valves 111 and 113 are syrup valves, and valves 112 and 114 are soda valves. The cross-section in FIG. 8 is taken through the syrup valves 111 and 113. The cross-section in FIG. 9 is taken through the valves 113 and 114.

The dispensing valve 110 includes the syrup piston 40, the soda piston 42, syrup chambers 44 and 46, soda chambers 48 and 50, and the nozzle 30. The dispensing valve 110 includes a body 118 having a syrup passageway 120 and a soda passageway 122 therethrough. The solenoid 116 includes a spring (not shown) for forcing the armature 117 downwardly (as viewed in FIG. 8). then the solenoid is energized it pulls the armature 117 upwardly. FIG. 8 shows the pistons 40 and 42 moving to the left, the paddle valves 113 and 114 being opened by the solenoid 116 being energized to pull upon a lever arm 126 (as viewed in FIG. 10), thus pushing down on the actuating arms 12B and 130 of the paddle valves 113 and 114 thus causing them to open. At the same time, the paddle valves 111 and 112 are caused to close. The soda and syrup flows through the soda and syrup passageways into the rightmost chambers 50 end 46 filling those chambers, and the soda and syrup is et the same time forced out of the leftmost chambers to the nozzle 30. At the end of the stroke of the pistons 40 and 42 to the left (as viewed in FIG. 8), the solenoid 116 is de-energized, whereby the solenoid spring (not shown) forces the lever arm 126 down, reversing the above described liquid flow.

Figure 11:
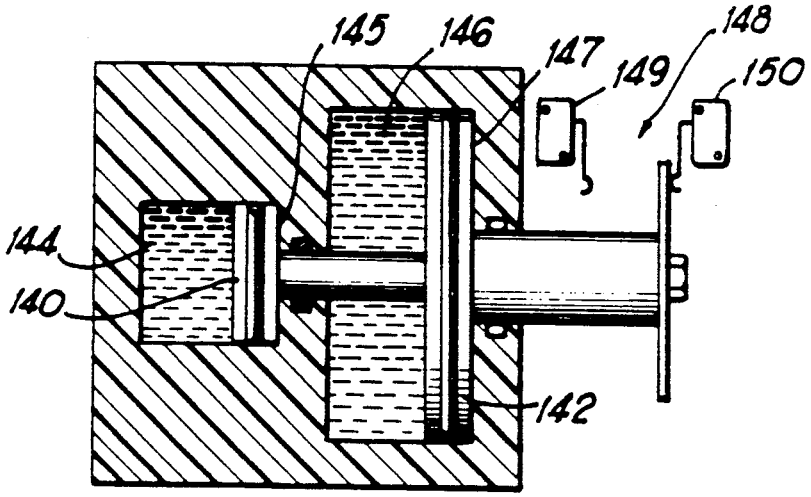
FIG. 11 is a partly diagrammatic, partly schematic view of a volumetric ratio control device showing an electrical switch means associated therewith.

FIG. 11 is a diagrammatic and schematic showing of a syrup piston 140, a soda piston 142, syrup chambers 144 and 145, and soda chambers 146 and 147. FIG. 11 also shows electrical circuit contact means 148 for detecting when the pistons 140 and 142 have reached the end of their stroke. The electrical contact means 148 can use microswitches 149 and 150 for energizing the solenoid means of the various valve means shown in the drawings of the previously described embodiments.

Figure 12:
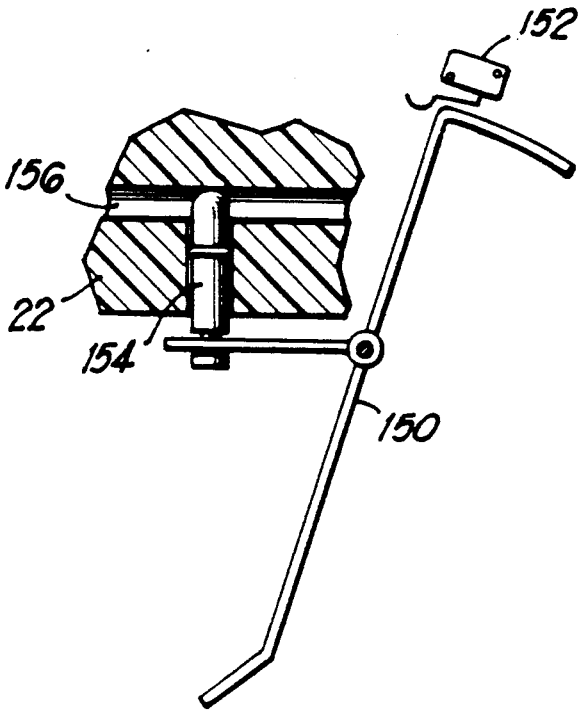
FIG. 12 is a partial, cross-sectional view of a dispensing valve showing a variable flow control feature thereof.

FIG. 12 shows a variable flow rate system that can be used on any of the above described embodiments. This system includes a cup lever arm 151 located below a dispensing valve 10 and adjacent to the nozzle 30 as is well known in the art for actuating a dispensing valve to dispense the beverage into a cup.

According to the invention shown in FIG. 12, movement of the cup lever arm 151 immediately energizes a switch 152 to actuate the dispensing valve. This switch remains closed as long as the arm 151 is depressed. The cup lever arm 151 is also connected to a flow control 154 (through an arm 153) in the soda passageway 156 to the nozzle 30. If a high flow rate is desired, the cup lever arm 151 is pushed all the way back, whereby the flow control 154 provides a completely open passageway 156. The cup lever arm 151 is spring biased to its closed position shown in FIG. 12 and can be moved varying amounts to the right (as viewed in FIG. 12) to dispense beverage into a cup and to open the soda passageway 156 in varying amounts. As the cup approaches being filled, the cup lever arm 151 is allowed to move toward its closed position whereby the flow control 154 moves into the passageway 156 to slow down the flow. By means of the volumetric ratio control device of the present invention, even though only one of the soda and/or syrup passageways to the nozzle is varied, the ratio remains constant, because when the piston slows down, it slows down the pumping of both the soda and the syrup and at the correct ratio.

Figure 13:
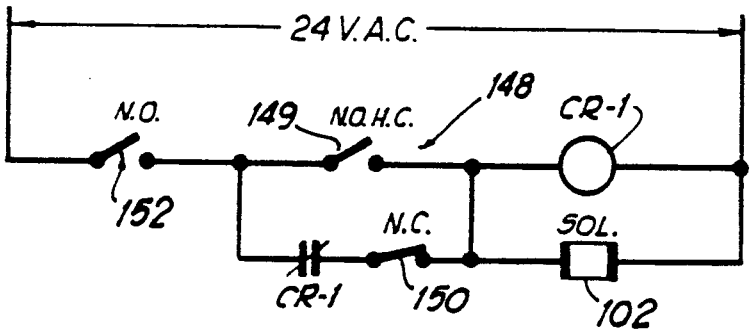
FIG. 13 is an electrical schematic of a circuit useful with the volumetric ratio control device of the present invention.

FIG. 13 shows a standard electrical circuit, including a holding circuit, for causing the soda and syrup pistons to reciprocate when the dispensing valve, including the VRCD, is energized. FIG. 13 shows the switches 152, 149 and 150, the solenoid 102 and relay CR-1. The operation of this standard circuit is well known and need not be described in any further detail herein.

FIG. 14 shows an overall arrangement of a beverage dispenser 12 with one or more dispensing valves 10 according to any one of the embodiments of the present invention. The beverage dispenser 12 can be provided with a syrup supply from any one of a known type of syrup containers such as a figal 14, a bag-in-box 16, or a gravity tank 18. In addition, according to the present invention, a syrup supply can also be provided in a non-returnable container 20 such as a plastic bottle. The container can be vented to atmosphere or preferably it can be a container that is capable of being safely pressurized to no higher than about 10 psig. The container 20 can be similar to the present two-liter PET bottles used for premix. The container 20 includes a lid 170 having a dip tube 172 extending down toward the bottom of the container 20 and a coupling for connection to the syrup line 21. The lid 170 also includes a one-way valve and fitting 174 for use in pressurizing the container 20 to its low pressure. It is noted that the pressure to which container 20 can be pressurized is much less than that to which a stainless steel figal 20 can be pressurized. According to the present invention, the means for delivering the syrup to the dispensing valve is the suction created by the volumetric ratio control device; however, it can be useful to have a small pressure in the container 20, if desired. However, the low pressure that is preferred to be used in the container 20 does not require the container to withstand any substantial pressures, whereby the container 20 can be made relatively inexpensively; that is, it can have relatively thin walls and a relatively inexpensive lid 170 that can be screw-threaded (or otherwise connected) onto the container 20 with a suitable 0-ring or other seal structure.

The container 14, 16 and 20 are connected in the usual, known, manner to the beverage dispenser 12; this is what is intended by the arrows on the ends of the syrup conduits. The dispenser 12 may or may not include a gravity tank 18.

While the preferred embodiments of this invention have been described above in detail, it is to be understood that variations and modifications can be made therein without departing from the spirit and scope of the present invention as set forth in the appended claims. For example, while certain arrangements and designs of pistons and chambers have been shown, a wide variety of such pistons and chambers can be used as will be understood by one skilled in the art. Further, it is not necessary that the piston be a double-acting piston arrangement; it can alternatively be a single-acting piston using a return spring, for example. while the preferred non-returnable container 20 is a rigid plastic bottle, a collapsible container such as a plastic bag similar to that used in the present bag-in-box containers 16 can also be used. The non-returnable container 20 can alternatively be vented to atmosphere and not be under any additional pressure. While the preferred water and concentrate are carbonated water and syrup, respectfully, this invention can also be used with plain water and with fruit juice concentrates, tea and coffee, for example. While the solenoids are preferably pull solenoids, push solenoids can also be used. The soda and syrup pistons in the VRCD can be separate pistons joined together, or they can be one single member.

What is claimed:

1. A dispensing valve for a beverage dispenser comprising:

(a) a body including a water passageway therethrough and a separate concentrate passageway therethrough;

(b) valve means for controlling the flow through said passageways;

(c) a nozzle for mixing together water and concentrate and for dispensing said mixture therefrom;

(d) a double acting volumetric ratio control device in said dispensing valve for controlling the ratio of water to concentrate in the beverage dispensed from said dispensing valve, said device including a water piston and a concentrate piston linked to said water piston, said piston being located in cylinders defining two water chambers and two concentrate chambers, said passageways including a water passageway in fluid communication with each water chamber and a concentrate passageway in fluid communication with each concentrate chamber;

(e) said valve means including four paddle valves, one in each of said pair of water and concentrate passageways, a single solenoid adapted to move a pivotable lever arm back and forth, and said lever arm being connected to said four paddle valves for opening and closing them; and (f) means for energizing said solenoid once for every cycle of operation of said device.

2. The apparatus as recited in claim 1 wherein said water is carbonated water and said concentrate is syrup.

3. The apparatus as recited in claim 1 wherein said piston reciprocates from side to said inside of said dispensing valve body.

4. The apparatus as recited in claim 1 wherein said valve means is located completely inside of said body.

* * * * *

UNITED STATES PATENT AND TRADEMARK OFFICE

CERTIFICATE OF CORRECTION

PATENT NO. : 5,071,038

DATED : December 10, 1991

INVENTOR(S) : William S. Credle, Jr.

It is certified that error appears in the above-identified patent and that said Letters Patent is hereby corrected as shown below:

In column 8, line 25, delete "said" and insert --side-- therefor.

Signed and Sealed this

First Day of June, 1993

*Attest:*

Michael K. Kirk

MICHAEL K. KIRK

*Attesting Officer*

*Acting Commissioner of Patents and Trademarks*